US008038240B2

(12) United States Patent
Tsai

(10) Patent No.: US 8,038,240 B2
(45) Date of Patent: Oct. 18, 2011

(54) ADJUSTABLE DOCKING PIN

(75) Inventor: Jason Victor Tsai, Lake Oswego, OR (US)

(73) Assignee: Xerox Corporation, Norwalk, CT (US)

( * ) Notice: Subject to any disclaimer, the term of this patent is extended or adjusted under 35 U.S.C. 154(b) by 419 days.

(21) Appl. No.: 12/406,195

(22) Filed: Mar. 18, 2009

(65) Prior Publication Data

US 2010/0236047 A1 Sep. 23, 2010

(51) Int. Cl.
*B41J 25/304* (2006.01)
*B41J 25/308* (2006.01)

(52) U.S. Cl. ..... 347/8; 400/55

(58) Field of Classification Search ..... 347/8; 400/55
See application file for complete search history.

(56) References Cited

U.S. PATENT DOCUMENTS 4,927,277 A * 5/1990 Niikawa ..... 400/56
5,187,497 A * 2/1993 Hirano et al. ..... 347/8
5,610,636 A * 3/1997 Hanabusa et al. ..... 347/8
5,975,666 A * 11/1999 Kawaguchi ..... 347/8
6,271,869 B1 8/2001 Tada et al.
7,918,526 B2 * 4/2011 Nobuta et al. ..... 347/19

* cited by examiner

*Primary Examiner* — Julian Huffman
(74) *Attorney, Agent, or Firm* — Maginot, Moore & Beck LLP

(57) ABSTRACT

A docking arrangement for establishing a gap between a first component and a second component comprises an adjustable spacer moveably positioned on the first component. The spacer defines a transverse channel and a cross pin extends through the transverse channel. The cross pin including a plurality of opposing surfaces with each of the opposing surfaces separated by a different distance. The cross pin further includes indicia representative of the different distances between the opposing surfaces. In at least one embodiment, the docking arrangement is configured for use in a printing machine with the spacer determining a gap between a print head mount and an imaging drum mount based on a selected set of the plurality of opposing surfaces.

20 Claims, 6 Drawing Sheets

ADJUSTABLE DOCKING PIN

FIELD

The embodiments disclosed herein relate generally to the field of kinematics and the positioning of two components a precise distance apart from each other. The embodiments disclosed herein more specifically relate to the field of printing and specifically to a printing device capable of moving a print head or other device configured to deliver marking material to a target surface from a precise distance.

BACKGROUND

Many mechanisms include a first component that must be moved to a position near to a second component such that the two components are separated by a precise standoff distance or gap. One example of such a mechanism is a printing system where a print head must be moved within a precise distance of a target to allow the print head to deliver clear and accurate images to the target.

One arrangement that has been used to accurately separate two components by a standoff distance involves the use of a docking pin or other spacer member. In these arrangements, the docking pin is mounted to and extends from the first component and the second component is moved into engagement with the docking pin. When the second component is moved into engagement with the docking pin, further movement between the components is prohibited, and a precise gap distance is established between the first and second component.

In mechanisms with docking pins, some form of positioning adjustment is often required to correct for fabrication and material tolerances or to compensate for wear of the mating surfaces. For example, if two components must be moved to a distance of precisely 1.875 mm apart, a 1 mm cumulative fabrication error in the assembly can create an unacceptable spacing between the two components. Thus, some form of adjustment is generally desirable to correct for fabrication and material tolerances in systems that utilize docking pins.

There are several known arrangements and related methods for correcting fabrication and material tolerances in systems that utilize docking pins. In a first known arrangement, the docking pin includes a threaded body that is partially threaded into the mounting platform. Rotating the pin results in varying height based on the thread pitch. In conjunction with this, shims are sometimes used. The shims may be made from sheet metal of an appropriate thickness. Multiple shims may be used with a threaded pin to set the pin to the desired height. Yet another option for correcting fabrication and material tolerances is to simply substitute an existing docking pin for a new docking pin having a different height.

The conventional solutions for correcting fabrication and material tolerances have several shortcomings. For example, when attempting to correct for the tolerance, it is difficult to determine the extent of the correction. This is true for both line operators in manufacturing as well as service technicians in the field. Furthermore, some methods have the additional disadvantage of loose parts which must be added or removed from the arrangement.

In view of the foregoing, it would be desirable to provide a solution for correcting fabrication and material tolerances in a docking arrangement. It would be particularly useful if such solution could be utilized in a printing system where a print head is moved toward and away from a target. In addition, it is also advantageous if the docking arrangement included feedback indicia so that the correct setting can be easily confirmed by manufacturers as well as service technicians.

SUMMARY

A docking arrangement for establishing a gap between a first component and a second component comprises an adjustable spacer moveably positioned on the first component. The spacer defines a transverse channel and a cross pin extends through the transverse channel. The cross pin including a plurality of opposing surfaces with each of the opposing surfaces separated by a different distance. The cross pin further includes indicia representative of the different distances between the opposing surfaces.

In at least one embodiment, the cross pin is configured as a prism having an even number of opposing sides. The indicia on the cross pin may be provided on each of the opposing surfaces of the cross pin. Furthermore, indicia includes a first indicia related to a first set of the opposing surfaces, a second indicia related to a second set of opposing surfaces, and a third indicia related to a third set of opposing surfaces, wherein the first indicia indicates a first distance, wherein the second indicia indicates a distance greater than the first distance, and wherein the third indicia indicates a distance less than the first distance.

In at least one embodiment, the docking arrangement is configured for use in a printing machine. The printing machine comprises an imaging drum and a first mount configured to support the imaging drum such that the imaging drum is rotatable relative to the first mount. The printing machine further comprises a print head configured to deliver marking material to the imaging drum. A second mount is configured to support the print head such that the print head is moveable relative to the second mount. A spacer is positioned between the first mount and the second mount. The spacer includes a transverse channel and a cross member is positioned in the transverse channel. The cross member includes a plurality of opposing surfaces. The diameter of the cross member is different between each of the opposing surfaces such that a spacer extension distance that determines a gap between the first mount and the second mount is based at least in part on a selected set of the plurality of opposing surfaces.

The above described features and advantages, as well as others, will become more readily apparent to those of ordinary skill in the art by reference to the following detailed description and accompanying drawings. While it would be desirable to provide a method and system for a docking arrangement that provides one or more of these or other advantageous features as may be apparent to those reviewing this disclosure, the teachings disclosed herein extend to those embodiments which fall within the scope of the appended claims, regardless of whether they include or accomplish one or more of the advantages or features mentioned herein.

DESCRIPTION

Figure 1A:
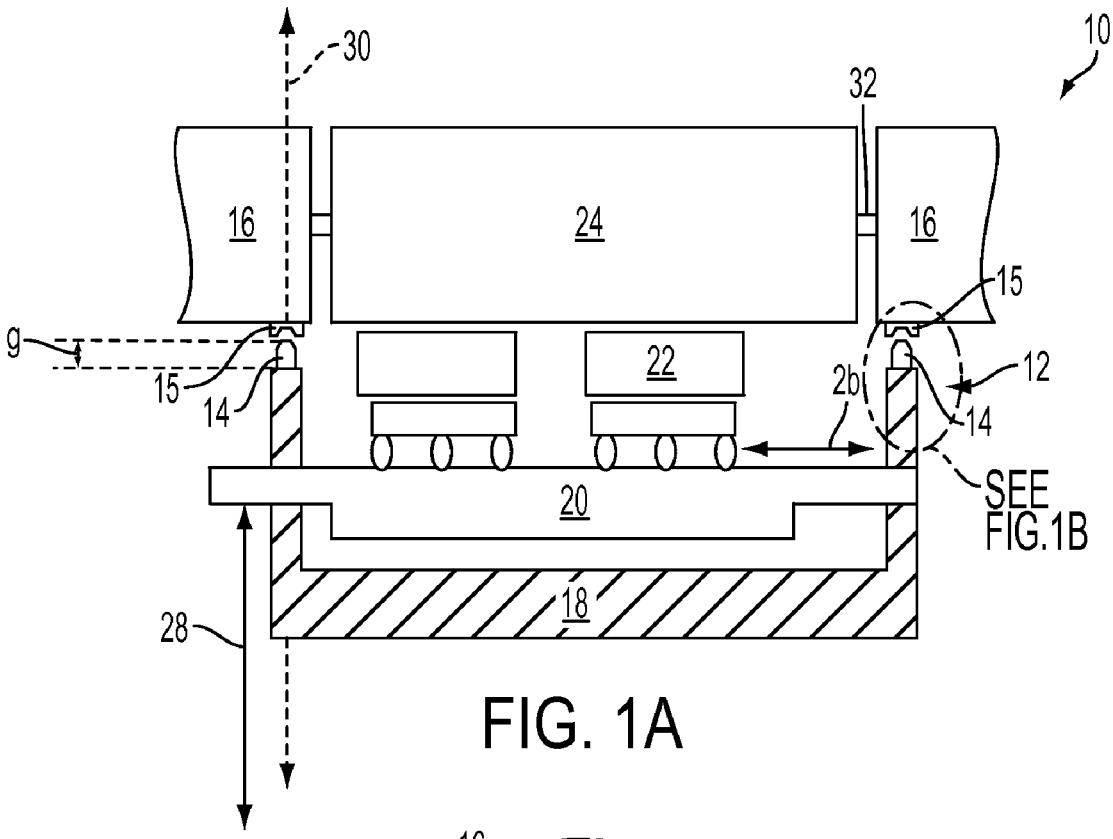
FIG. 1A shows a diagrammatic view of a printing machine including a docking arrangement with an adjustable docking pin.
Figure 1B:
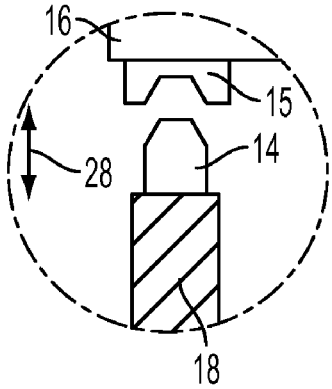
FIG. 1B shows an enlargement of the portion encircled by dotted lines in FIG. 1A.
Figure 2:
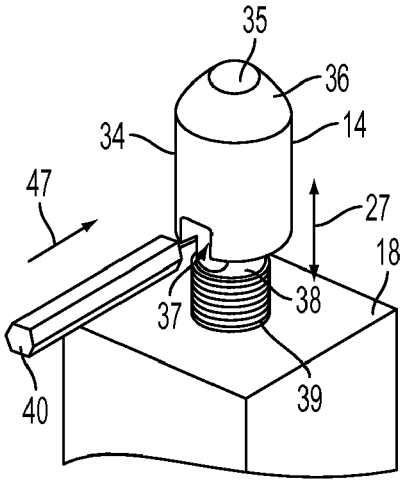
FIG. 2 shows a perspective view of an exemplary embodiment of a spacer and cross pin for use with the docking arrangement of FIG. 1A.

With reference to FIGS. 1A and 1B, an exemplary embodiment of a docking arrangement using an adjustable docking pin or spacer is shown in a printing device 10. The docking arrangement 12 includes a plurality of spacers 14 positioned between an imaging drum mount 16 and a print head mount 18. The spacers 14 are mounted on the print head mount 18.

The print head mount 18 holds a translation carriage 20, which in turn holds a plurality of print heads 22. The print heads 22 eject ink on to a target, such as an imaging drum 24. The translation carriage 20 moves the print heads 22 back and forth on the print head mount 18, as indicated by arrow 26, to address different locations across the width of the target. Furthermore, the print head mount 18 moves toward or away from the imaging drum 24, as indicated by arrow 28.

The imaging drum mount 16 holds the imaging drum 24 in the printing machine 10. The imaging drum 24 is rotatable relative to the mount 16 and is connected to the mount at axle 32. An electric motor and drive train arrangement (not shown) in the printing machine impart rotation to the axle 32 and imaging drum 24. Receptacles 15 provide a docking surface configured to receive the spacers 14. The docking surface is tapered to match the frusto-conical head of the spacers 14.

The spacers 14 are attached to the print head mount 18. The spacers 14 include a threaded portion (not shown in FIGS. 1A and 1B) embedded in complementary threaded holes formed in the mount 18. Thus, rotation of one of the spacers 14 results in movement of the spacer 14 relative to a surface of the mount 18 along a separation axis 30. The spacers 14 extend from the surface of the mount 18 and, along with the receptacles 15, define a separation distance or gap "g" (also referred to herein as a spacer extension distance). Rotation of a spacer in one direction shortens the distance "g". Rotation of the spacer in the opposite direction lengthens the distance "g". As explained in further detail below, the spacers 14 are configured for use with cross pins that allow each of the spacers 14 to define a precise separation distance "g" and account for various manufacturing tolerances and other irregularities.

During operation of the printing device 10, the print heads 22 are moved toward and away from the imaging drum 24, as indicated by arrow 28. When moved toward the imaging drum 24, the print heads 22 are moved until the receptacles 15 on the imaging drum mount 16 come into contact with the spacers 14 connected to the print head mount 18. Thus, the spacers 14 are used to dock the print head mount 18 with a precise gap between the print head mount 18 and the imaging drum mount 16, as defined by the separation distance "g". With the print head mount 18 docked in a precise location, the print heads 22 are established at a proper distance from the imaging drum 24, thus allowing the print heads 22 to print a clear and precise image on the imaging drum 24.

Because the retractable print head mount 18 must be placed at the proper height and orientation relative to the target substrate, three spacers 14 may be used to provide stability and full planarity adjustment for the mount. While FIG. 1A only shows two spacers 14, additional spacers may be positioned directly behind the spacers shown in order to provide three or more spacers in the docking arrangement.

With reference now to FIGS. 2-5, an exemplary spacer and cross pin arrangement is shown for use with the printing machine of FIG. 1A. The spacer 14 includes a cylindrical portion 34 positioned between a cone shaped nose 36 and a threaded post 38. The cone shaped nose 36 includes a blunt surface 35 designed to abut the receptacle 15 positioned on the imaging drum mount 16 (see FIG. 1A) when the print head mount 18 is moved toward the imaging drum mount 16. An opening 37 is formed in the spacer 14 between the cylindrical portion 34 and the threaded post 38. The opening 37 forms a transverse channel that extends all the way through the spacer 14. The threaded post 38 extends away from the cylindrical portion 34 and includes a plurality of threads 39. The threads 39 on the post 38 are configured to engage complimentary threads 19 in a hole 17 formed in the mount 18 (see FIG. 4). Rotation of the spacer 14 results in movement of the spacer 14 toward or away from the surface of the mount 18, as indicated by arrow 27 in FIG. 2. This direction 27 is substantially perpendicular to orientation of the channel formed by the opening 37 in the spacer.

A cross member 40 is used to set the spacer 14 a precise separation distance from the surface of the mount 18. As shown in the embodiment of FIGS. 2-5, the cross member is provided in the form of a prism shaped cross pin 40. The cross pin 40 is designed and dimensioned to fit into and extend through the transverse channel 37 of the spacer 14. The cross pin 40 includes a plurality of support surfaces 41-46. Each support surface 41-43 includes a directly opposing support surface 44-46. Thus, three different sets of opposing surfaces are provided in the embodiment of FIGS. 2-5: particularly, opposing surfaces 41 and 44, opposing surfaces 42 and 45 and opposing surfaces 43 and 46. The diameter of the cross pin 40 is different between each set of opposing surfaces 41 and 44, 42 and 45 or 43 and 46. Thus, in FIG. 5, the distance $d_1$ between support surfaces 41 and 44 is different from distance $d_2$ between support surfaces 42 and 45, and the distances $d_1$ and $d_2$ are different from the distance $d_3$ between support surfaces 43 and 46.

Figure 3:
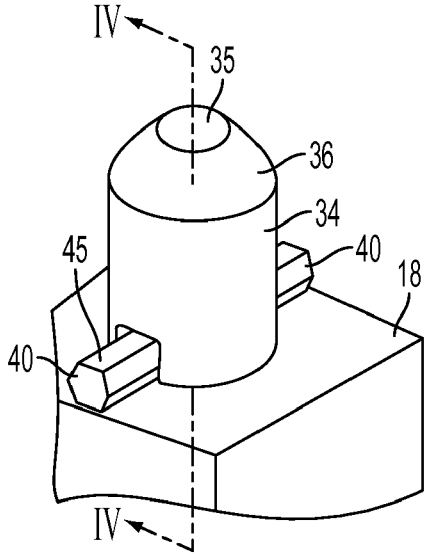
FIG. 3 shows a perspective view of the spacer and cross pin of FIG. 2 assembled in a mount.
Figure 4:
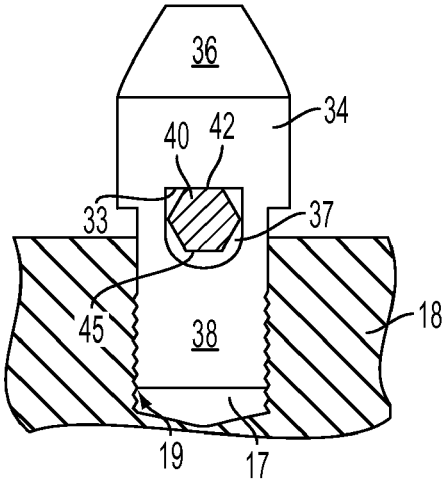
FIG. 4 shows a cross-sectional view of the spacer and cross pin of FIG. 3 along line IV-IV.
Figure 5:
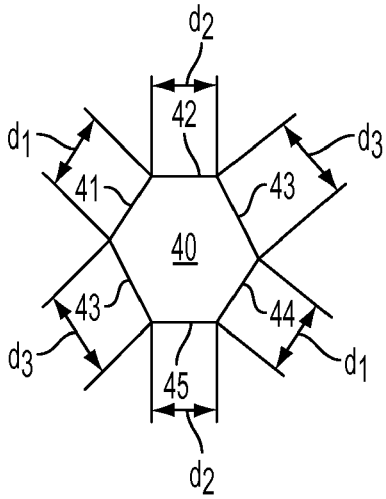
FIG. 5 shows an enlarged cross-sectional view of the cross pin of FIG. 4.
Figure 6:
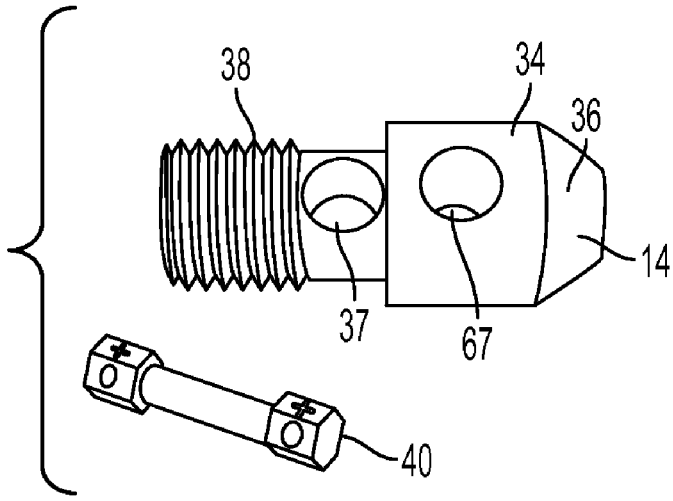
FIG. 6 shows a perspective view of another exemplary embodiment of a spacer and cross pin for use with the docking arrangement of FIG. 1A.
Figure 7:
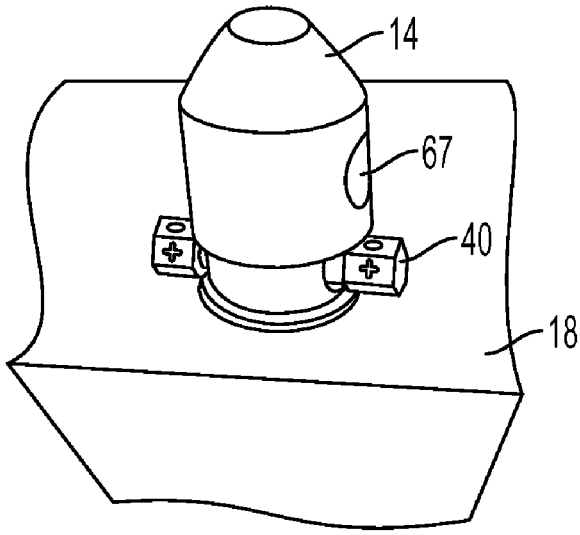
FIG. 7 shows a perspective view of the spacer and cross pin of FIG. 6 assembled in a mount.
Figure 8A:
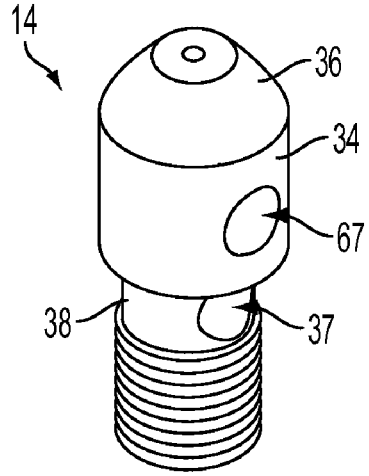
FIG. 8A shows a perspective view of the spacer of FIG. 6.
Figure 8B:
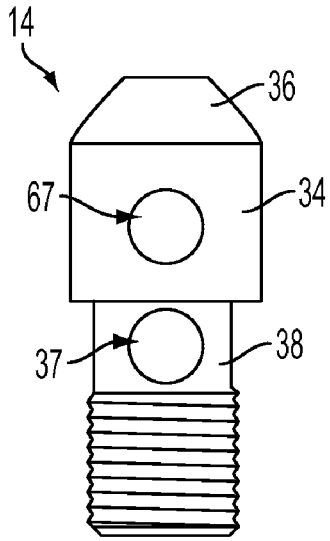
FIG. 8B shows a first elevational view of the spacer of FIG. 8A.
Figure 8C:
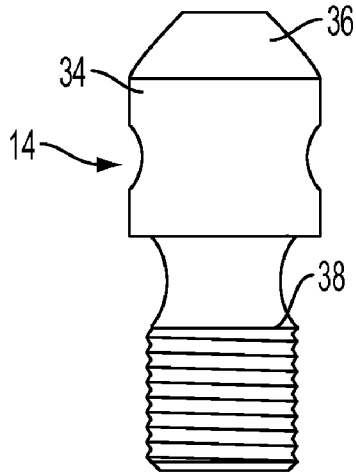
FIG. 8C shows a second elevational view of the spacer of FIG. 8A.

As shown in FIGS. 3 and 4, one of the sets of opposing support surfaces is selected to set the spacer extension distance. The selected set of opposing surfaces results in one support surface of the cross pin 40 engaging a wall 33 in the transverse channel 37 and another support surface engaging the surface of the mount 18. In FIGS. 3 and 4, support surface 42 engages the wall 33 in the transverse channel 37, and the opposite support surface 45 engages the surface of the mount 18. Accordingly, the cross pin 40 serves as a wedge that is clamped between the mount 18 and the transverse channel 37.

In the disclosed embodiment, a user selects a set of support surfaces on the cross pin 40 by orienting one of the support surfaces upward (i.e., directed toward the upper wall 33 of the channel 37). The user then inserts the cross pin 40 into the channel 37 of the spacer, as indicated by arrow 47 in FIG. 2. After inserting the cross pin 40 into the channel 37, the user rotates the spacer 14 until it tightly clamps down on the cross pin 40 and locks the spacer 14 and cross pin 40 in place on the mount 18. The precise distance the spacer 14 extends from the mount 18 is based on the diameter of the cross pin 40 between the selected opposing support surfaces of the cross pin. Because the distances $d_1$, $d_2$ and $d_3$ between the sets of opposing surfaces on the cross pin 40 are all different, a user may select the set of opposing surfaces that most closely sets the spacer 14 to extend a desired distance from the mount 18.

With reference now to FIGS. 6-9C, an alternative embodiment of the spacer and cross pin arrangement is shown. Similar to the embodiment of FIG. 2, in the embodiment of FIGS. 6-9C, the spacer includes a cylindrical portion 34, a cone shaped nose 36, and a threaded post 38. However, in the embodiment of FIGS. 6-9C, the spacer includes two transverse channels 37 and 67. The first transverse channel 37 is designed to receive the cross pin 40. The second transverse channel 67 is configured to receive the shaft of a screwdriver or other device that may be inserted into the channel 67 and rotated in order to tighten the spacer in the mount 18.

Figure 9A:
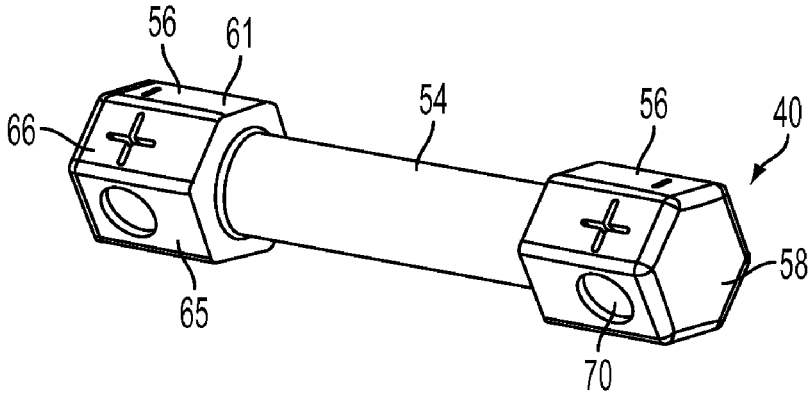
FIG. 9A shows a perspective view of the cross pin of FIG. 6.
Figure 9B:
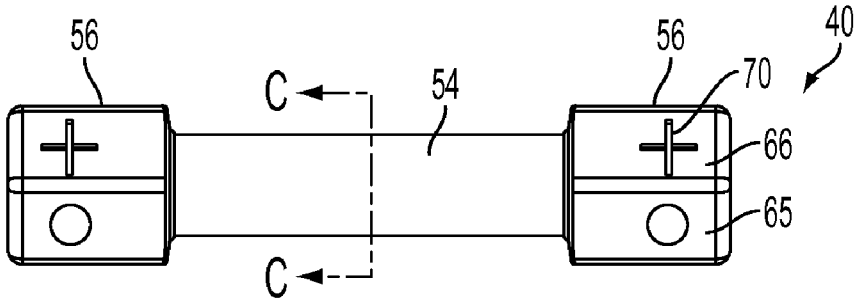
FIG. 9B shows an elevational view of the cross pin of FIG. 9A.
Figure 9C:
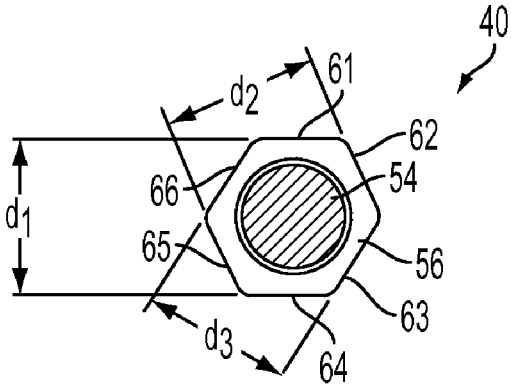
FIG. 9C shows a cross sectional view of the cross pin of FIG. 9B along line C-C.

The cross pin in the embodiment of FIGS. 6-9C is dumbbell shaped and includes a cylindrical bar 54 extending between two enlarged end portions provided as knobs 56. Each of the enlarged end portions 56 is prism shaped and provides a plurality of support surfaces 61-66. The plurality of support surfaces 61-66 are configured as a plurality of opposing surface sets, including surfaces 61 and 64, 62 and 65, and 64 and 66. As best seen in FIG. 9C, the diameter of the wedge is different across each of the plurality of opposing surface sets. The diameter across opposing surface set 61 and 64 is shown as distance $d_1$, the diameter across opposing surface set 62 and 65 is shown as distance $d_2$, and the diameter across opposing surface set 63 and 66 is shown as distance $d_3$. Each of distances $d_1$-$d_3$ provides a slightly different diameter across the prism of formed by the enlarged end portion 56. For example, diameter $d_1$ may be 2.9 mm, diameter $d_2$ may be 3.0 mm, and diameter $d_3$ may be 3.1 mm. This provides a user with three different opposing surface sets which may be used to slightly adjust the distance the spacer 14 extends from the mount 18.

In order to assist the user in selecting the desired support surfaces, indicia 70 are provided on the cross pin to represent the different distances between the opposing surfaces. For example, as best seen in FIGS. 9A and 9B, the surface set that includes surfaces 61 and 64 is marked with a "–" to indicate that the diameter between these surfaces is the smallest diameter on the cross pin. Similarly, the surface set that includes surfaces 62 and 65 is marked with an "o" to indicate that the diameter between these surfaces is a middle diameter on the cross pin. Furthermore, the surface set that includes surfaces 63 and 66 is marked with a "+" to indicate that the diameter between these surfaces is the largest diameter on the cross pin. It will be recognized that other indicia 70 other than "+", "o", and "–" may be used to indicate diameter distances. For example, actual diameter distances may be inscribed on the cross pin, or a blank may be used in place of a zero indication. Also, the indicia 70 may be located on some other portion of the cross pin than the support surfaces 61-66. For example, the indicia may be placed on the ends 58 of the cross pin 40. Furthermore, it will be recognized that the indicia 70 may be inscribed, printed or otherwise marked on the cross pin 40.

Figure 10A:
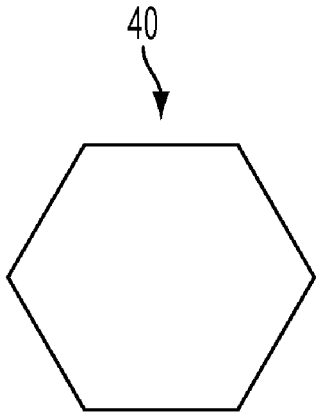
FIG. 10A shows an exemplary hexagonal cross-sectional shape of the cross pin of FIGS. 2 or 9A.
Figure 10B:
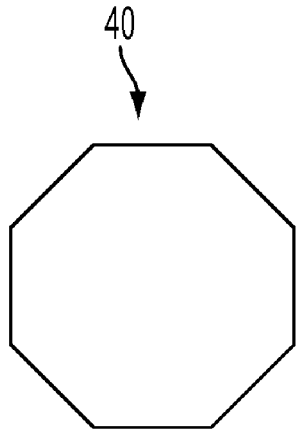
FIG. 10B shows an exemplary octagonal cross-sectional shape of the cross pin of FIGS. 2 or 9A.

In the embodiments described above, including the embodiment of FIGS. 2-5 and the embodiment of 6-9C, the cross pin 40 is shown as having a total of six supporting surfaces, resulting in three different opposing surface sets. However, it will be recognized that any number of supporting surfaces and arrangements are possible. Various examples of different supporting surface arrangements are shown in FIGS. 10A-10D. FIG. 10A represents the arrangement where the cross pin includes a prism shaped portion with six sides that provide six support surfaces, similar to that shown in the embodiment of FIGS. 2-5. FIG. 10B represents an arrangement where the cross pin includes a prism shaped arrangement with eight sides providing eight support surfaces.

Figure 10C:
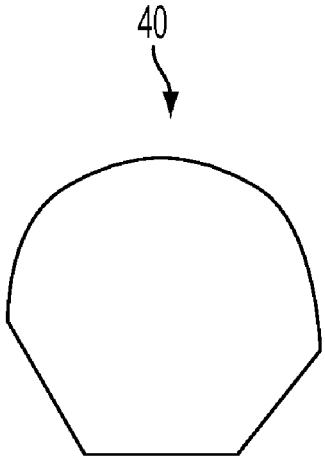
FIG. 10C shows another exemplary cross-sectional shape of the cross pin of FIGS. 2 or 9A.
Figure 10D:
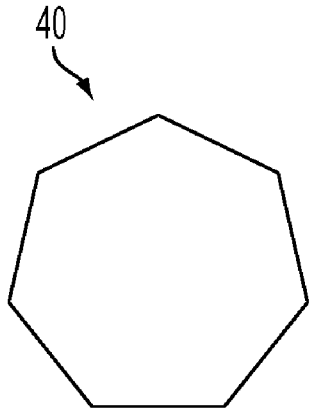
FIG. 10D shows an exemplary heptagonal cross-sectional shape of the cross pin of FIGS. 2 or 9A.

FIGS. 10C and 10D represent arrangements where each set of opposing support surfaces includes only one flat surface and the surface opposing each flat support surface is curved, includes an apex, or other non-flat features. Using at least one flat surface provides stability for the height setting when the spacer is secured with force against the cross pin. The limiting surface or feature opposite the flat surface can be any shape and may be a different shape for each of the height setting feature pairs.

In the embodiment of FIG. 10C, the cross pin includes four support surfaces, three of the support surfaces being flat, and one of the support surfaces being rounded or curved. Thus, in the embodiment of FIG. 10C, the opposing support surfaces would include one flat surface and one round surface. The separation distance of the spacer is influenced by the distance between the selected flat surface and the opposing rounded surface of the cross pin.

FIG. 10D represents an embodiment where the cross pin includes a prism shaped portion with an odd number of sides (i.e., seven flat surfaces). In this embodiment, each of the opposing surface sets is defined by one of the flat surfaces and the edge (or apex) that extends between two of the adjoining flat surfaces. Accordingly, seven different opposing surface sets are defined in the embodiment of FIG. 10D.

As described previously, an operator or manufacturer of a printing machine may use the docking arrangement with adjustable docking pin as described in the above embodiments to set an optimal distance or gap between a print head and a mounting substrate. Multiple heads can then be set to essentially equivalent heights. Direct measurements or objective or subjective test prints, or system internal sensors and feedback within the printing system, may be used as a basis to determine which setting is optimal. The adjustable docking pin provides a predetermined range for adjusting the gap, and can only be set to incremental positions (i.e. steps) within this range. The range limits and incremental positions make it easier to set known positions and to stay within the tolerance allocation, thus reducing the risk improper adjustments, which could result in part damage or poor image quality. By providing this adjustment capability, the adjustable docking pin allows the printing machine to meet print quality specifications without the high cost of precision components.

It should be noted that the word "printer", "printing device" or "printing system" as used herein encompasses any apparatus, such as a digital copier, bookmaking machine, facsimile machine, multi-function machine, etc. which performs a print outputting function for any purpose. Furthermore, the term "marking material" as used herein encompasses any colorant or other material used to mark on paper or other media. Examples of marking material include inks, toner particles, pigments, and dyes.

Although the various embodiments have been provided herein, it will be appreciated by those of skill in the art that other implementations and adaptations are possible. For example, while the above disclosure presents one exemplary embodiment of a printing machine adapted for use the docking arrangement described herein, it will be recognized that the docking arrangement described herein may also be used with different printing machines, various types of other machines in general (i.e., machines other than printing machines), and with various other components. As another example, the cross pin may be comprised of a magnetic material such that a magnetic attraction is established between the cross pin and the docking pin. Furthermore, aspects of the various embodiments described herein may be combined or substituted with aspects from other features to arrive at different embodiments from those described herein. Thus, it will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A docking arrangement for establishing a gap between a first component and a second component, the docking arrangement comprising:

a spacer moveably positioned on the first component, the spacer defining a transverse channel;

a cross pin extending through the transverse channel of the spacer, the cross pin including a plurality of opposing surfaces with each of the opposing surfaces separated by a different distance; and indicia on the cross pin representative of the different distances between the opposing surfaces.

2. The docking arrangement of claim 1 wherein the opposing surfaces are configured as sides of a prism having an even number of sides.

3. The docking arrangement of claim 2 wherein the prism comprises at least six sides.

4. The docking arrangement of claim 1 wherein the indicia on the cross pin includes indicia on each of the opposing surfaces.

5. The docking arrangement of claim 1 wherein the plurality of opposing surfaces includes at least three sets of opposing surfaces defining three different distances.

6. The docking arrangement of claim 5 wherein the indicia includes a first indicia related to a first set of the opposing surfaces, a second indicia related to a second set of opposing surfaces, and a third indicia related to a third set of opposing surfaces, wherein the first indicia indicates a first distance, wherein the second indicia indicates a distance greater than the first distance, and wherein the third indicia indicates a distance less than the first distance.

7. The docking arrangement of claim 1 wherein the spacer threadedly engages the first component.

8. The docking arrangement of claim 7 wherein rotation of the spacer results in movement of the spacer relative to the first component in an axial direction that is substantially perpendicular to the transverse channel.

9. The docking arrangement of claim 1 wherein the cross pin includes a first enlarged end, a second enlarged end and a connecting member extending between the first enlarged end and the second enlarged end, and wherein the indicia are provided on the first enlarged end.

10. The docking arrangement of claim 9 wherein the plurality of opposing surfaces are provided on the first enlarged end and wherein the second enlarged end includes a plurality of complementary opposing surfaces.

11. A printing machine comprising:

an imaging drum;

a first mount configured to support the imaging drum such that the imaging drum is rotatable relative to the first mount;

a print head configured to deliver marking material to the imaging drum;

a second mount configured to support the print head such that the print head is moveable relative to the second mount;

a spacer positioned between the first mount and the second mount, the spacer including a transverse channel; and a cross member positioned in the transverse channel of the spacer, the cross member including a plurality of opposing surfaces, wherein the diameter of the cross member is different between each of the opposing surfaces such that a spacer extension distance that determines a gap between the first mount and the second mount is based at least in part on a selected set of the plurality of opposing surfaces.

12. The printing machine of claim 11 wherein the spacer is moveably connected to the second mount and wherein the spacer extension distance is defined between an end of the spacer and the second mount.

13. The printing machine of claim 12 wherein the spacer is threadedly connected to the second mount such that rotation of the spacer changes the spacer extension distance.

14. The printing machine of claim 11 wherein the cross member is provided as a cross pin having a prism portion with the plurality of opposing surfaces provided on the prism portion of the cross pin.

15. The printing machine of claim 11 further comprising indicia on the cross member representative of the different diameters of the cross member between each of the opposing surfaces.

16. The printing machine of claim 11 wherein the plurality of opposing surfaces of the cross member includes at least three sets of opposing surfaces defining three different diameters for the cross member.

17. An arrangement for separating a first component from a second component, the arrangement comprising:

a spacer moveably positioned on the first component along a separation axis that extends through the spacer and the first component;

an opening in the spacer, the opening defining an interior wall; and a wedge positioned in the opening in the spacer, the wedge including a plurality of support surfaces configured as a plurality of opposing surface sets, wherein the diameter of the wedge is different across each of the plurality of opposing surface sets, and wherein a selected opposing surface set includes one surface engaging the interior wall of the opening and an opposite surface engaging the surface of the first component such that the distance the spacer extends from the first component is based at least in part on the diameter of the wedge across the selected opposing surface.

18. The arrangement of claim 17 further comprising indicia on the wedge representative of the different diameters of the wedge across each of the plurality of opposing surface sets.

19. The arrangement of claim 18 wherein the indicia are provided on the plurality of support surfaces.

20. The arrangement of claim 17 wherein the spacer threadedly engages a hole in the first component such that rotation of the spacer results in movement of the spacer along the separation axis.

* * * * *